United States Patent [19]

McDonnell

[11] 3,983,823

[45] Oct. 5, 1976

[54] SHELF MOUNTING ARRANGEMENT

[76] Inventor: Thomas M. McDonnell, 11 N. 4th Ave., Maywood, Ill. 60153

[22] Filed: Nov. 28, 1975

[21] Appl. No.: 635,850

[52] U.S. Cl. ..... 108/144; 108/107; 108/152; 248/243

[51] Int. Cl.[2] ..... A47B 5/00; A47B 9/00

[58] Field of Search ..... 108/152, 144, 27, 158, 108/107, 108, 109; 248/243; 211/148, 133, 90

[56] References Cited

UNITED STATES PATENTS

| | | | |
|---|---|---|---|
| 1,290,072 | 1/1919 | Bullock | 108/27 |
| 3,234,897 | 2/1966 | Berk | 248/243 X |
| 3,286,662 | 11/1966 | Connery | 108/144 |
| 3,352,584 | 11/1967 | Engel | 211/148 X |

*Primary Examiner*—Ramon S. Britts
*Assistant Examiner*—Darrell Marquette

[57] ABSTRACT

A mounting arrangement for supporting a vertically adjustable shelf, from a vertical standard having a plurality of vertically spaced apertures, by means of a mounting bracket interposed between the shelf and standard.

6 Claims, 4 Drawing Figures

SHELF MOUNTING ARRANGEMENT

SUMMARY OF THE INVENTION

The invention relates to shelf arrangements and more particularly to an arrangement for supporting a relatively small display type shelf from a conventional vertical standard of the type commonly used in retail merchandising stores, in combination with one or more similar standards, for supporting elongated display shelves.

It is an object of the present invention to provide an arrangement for supporting a relatively small shelf from a single vertical standard.

A more specific object of the invention is the provision, in a shelf arrangement of the type described, of a shelf having a vertical flange attached to a mounting bracket which is adapted to receive and be secured to a conventional vertical standard, whereby the position of the shelf may be readily adjusted to a desired height.

These and other objects of the invention will be apparent from an examination of the following description and drawings.

THE DRAWINGS

Figure 1:
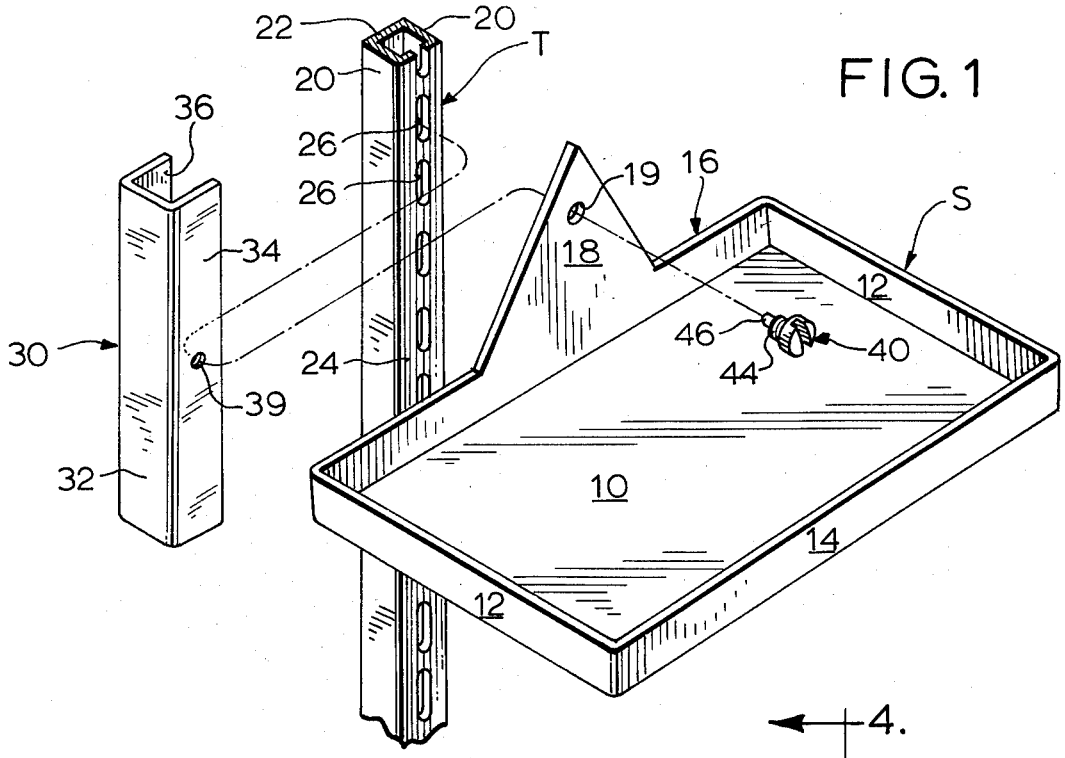
FIG. 1 is a fragmentary, exploded, perspective view of a shelf mounting arrangement embodying features of the invention.
Figure 3:
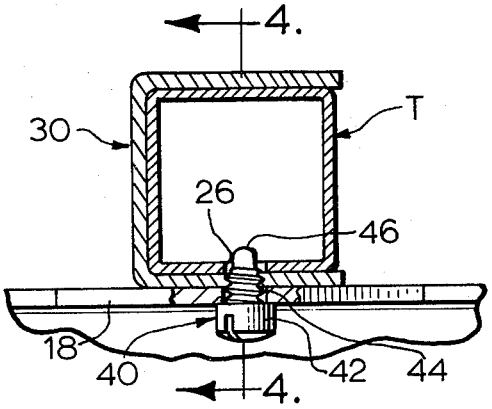
FIG. 3 is a fragmentary transverse section taken on line 3—3 of FIG. 2.

It will be understood that, for purposes of clarity, certain elements may have been intentionally omitted from certain views where they are believed to be illustrated to better advantage in other views.

Referring now to the drawing for a better understanding of the invention and particularly to FIGS. 1 and 2, it will be seen that the novel shelf mounting arrangement includes a shelf, indicated generally at S, which is mounted on a vertical standard, indicated generally at T, by means of a novel mounting bracket or adaptor 30, the details of which are described later in the specification.

Figure 2:
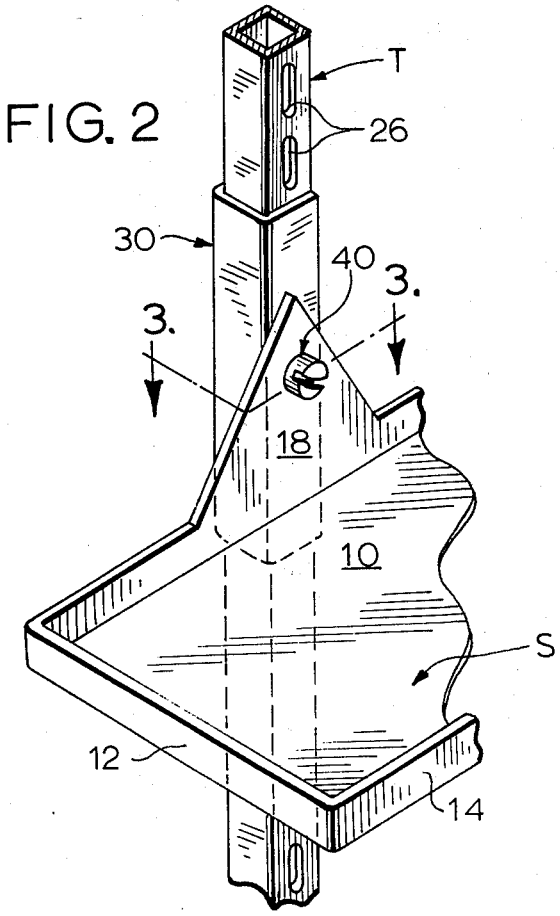
FIG. 2 is a view similar to FIG. 1, but with the shelf and bracket shown attached to a vertical standard.
Figure 4:
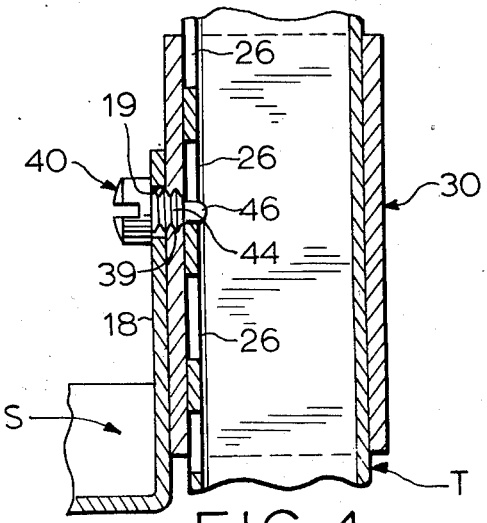
FIG. 4 is a fragmentary vertical section taken on line 4—4 of FIG. 3.

The Shelf S, as best seen in FIG. 1, includes a bottom wall 10 having opposed end walls 12 upstanding from the end edges thereof and opposed front and rear side walls 14 and 16 upstanding from the front and rear edges thereof to form therewith a tray-like structure. Rear side wall 16 is provided with a medially disposed, preferably triangular shaped extension 18 projecting upwardly therefrom and having a threaded aperture 19 extending therethrough. The specific design of the shelf is not essential to the invention, so long as the shelf has a vertical flange of some type, like extension 18, for use in mounting the shelf to the standard as hereinafter described.

As best seen in FIG. 1, shelf S is adapted to be mounted on a vertically disposed standard T which is generally rectangular in transverse cross-section. Standard T includes a pair of opposed side walls 20 and a pair of rear and front walls 22 and 24 which form a hollow structure. Front wall 24 is provided with a plurality of vertically spaced apertures or slots 26 which accommodate the mounting of shelf S at any desired height.

In order to removably attach shelf S to standard T there is provided a mounting bracket or adaptor 30, which is the essential feature of the present invention.

Bracket 30, as best seen in FIG. 1, is preferably an elongated, channel shaped article which includes a side wall 32 having extending laterally from its front and rear edges a pair of integral front and rear walls 34 and 36 respectively, which define a generally U-shaped channel 38 which is complementary to the contour of standard T, so that the bracket 30 will snugly encompass the standard. Front wall 34 is provided with an aperture 39 which is preferably threaded in the same manner as aperture 19 in the flange or extension 18 of the shelf S.

In order to detachably mount shelf S on standard T at any desired height, bracket 30 is placed over standard T with the aperture 39 of the bracket aligned with a selected aperture 26 of the standard. Shelf S is then placed against the standard and the bracket with aperture 19 of the shelf aligned with the apertures of the standard and bracket.

In the form of the invention illustrated, the shelf, bracket and standard are secured together by means of a bolt 40 which includes a head 42 and a shaft having a threaded portion 44 and an unthreaded portion 46. The bolt is extended through the aligned apertures with its threaded portion 44 in threadable engagement with the apertures of the shelf and bracket and with its unthreaded end portion received with an aperture 26 of the standard.

Thus, the shelf and bracket are securely fastened together and in snug engagement with the standard. To change the position or elevation of the shelf relative to the standard, bolt 40 is removed and reinserted in the aligned apertures of the shelf, bracket, and standard after the shelf and bracket have been raised or lowered to the desired height.

It is not absolutely necessary to provide a threaded bolt such as 40; if desired, the apertures of the shelf and bracket can be made rectangular, as are the apertures of the standard. In this case an unthreaded pin which is rectangular in cross-section could be used to attach the shelf to the bracket and standard.

Thus, it will be appreciated that the invention provides a relatively simple arrangement, which is readily adjustable, for supporting an individual shelf from a conventional vertical standard.

I claim:

1. In a mounting arrangement for supporting a shelf from a vertically disposed standard which is generally rectangular in transverse cross-section and which includes a front wall having extending therethrough a plurality of vertically spaced apertures, the combination of:

a. a shelf having adjacent one side thereof an upwardly projecting flange with an aperture extending therethrough;

b. a bracket for securing said shelf to the standard at a desired height, including a side wall and a pair of integral front and rear walls extending laterally from the front and rear edges of said side wall to form therewith a generally rectangular shaped channel for receiving said standard therein, said mounting bracket front wall having an aperture extending therethrough;

c. fastening means extending through aligned apertures of said shelf, bracket, and standard for securing said shelf to said standard at a desired height.

2. A mounting arrangement according to claim 1, wherein said shelf includes a bottom wall and opposed pairs of side and end walls upstanding therefrom to provide a tray-like structure, and wherein said flange is formed by an extension of one of said shelf side walls.

3. A mounting arrangement, according to claim 1, wherein said bracket is elongated and covers a plurality of apertures of said standard.

4. A mounting arrangement, according to claim 1, wherein said fastening means includes a bolt which has a threaded portion which is threadably engageable with the apertures of one of said shelf and said bracket.

5. A mounting arrangement according to claim 1, wherein the apertures of said shelf and said bracket are threaded, and wherein said fastening means includes a bolt having threaded engagement with said shelf and bracket apertures.

6. A mounting arrangement, according to claim 1, wherein said bracket is elongated and extends above and below the upper and lower extremities of said shelf.

* * * * *